United States Patent [19]

Harrison

[11] 3,937,518

[45] Feb. 10, 1976

[54] RECLINER LOUNGER T-CUSHION CHAIR WITH PROJECTIBLE HEADREST AND LEGREST, AND HARDWARE THEREFOR

[75] Inventor: Kenneth S. Harrison, Ridgefield Park, N.J.

[73] Assignee: Mohasco Corporation, Amsterdam, N.Y.

[22] Filed: Jan. 9, 1975

[21] Appl. No.: 539,641

[52] U.S. Cl. ..... 297/61; 297/83

[51] Int. Cl.[2] ..... A47C 1/03

[58] Field of Search ..... 297/61, 85, 88, 89, DIG. 7, 297/90, 84, 68, 83, 391, 408, 409, 410

[56] References Cited

UNITED STATES PATENTS

| | | | |
|---|---|---|---|
| 3,162,483 | 12/1964 | Fletcher | 297/89 |
| 3,433,527 | 3/1969 | Re' | 297/85 |
| 3,493,264 | 2/1970 | Re' | 297/DIG. 7 |
| 3,522,969 | 8/1970 | Re' | 297/89 X |
| 3,847,430 | 11/1974 | Fletcher | 297/61 |
| 3,856,346 | 12/1974 | Herman | 297/61 |
| 3,865,432 | 2/1975 | Rogers, Jr. | 297/61 |
| 3,871,705 | 3/1975 | Harrison | 297/61 |

*Primary Examiner*—James T. McCall
*Attorney, Agent, or Firm*—J. B. Felshin

[57] ABSTRACT

In this chair, the hardware has means to hold the seat against backward movement, while allowing movement of the seat up and down and forwardly. The headrest and legrest are projected when going from upright to T.V. position and the headrest and legrest remain in projected position when going from T.V. position to fully reclined position and from fully reclined position back to T.V. position; and they are retracted when going from T.V. position back to upright position.

16 Claims, 2 Drawing Figures

Figure 1:
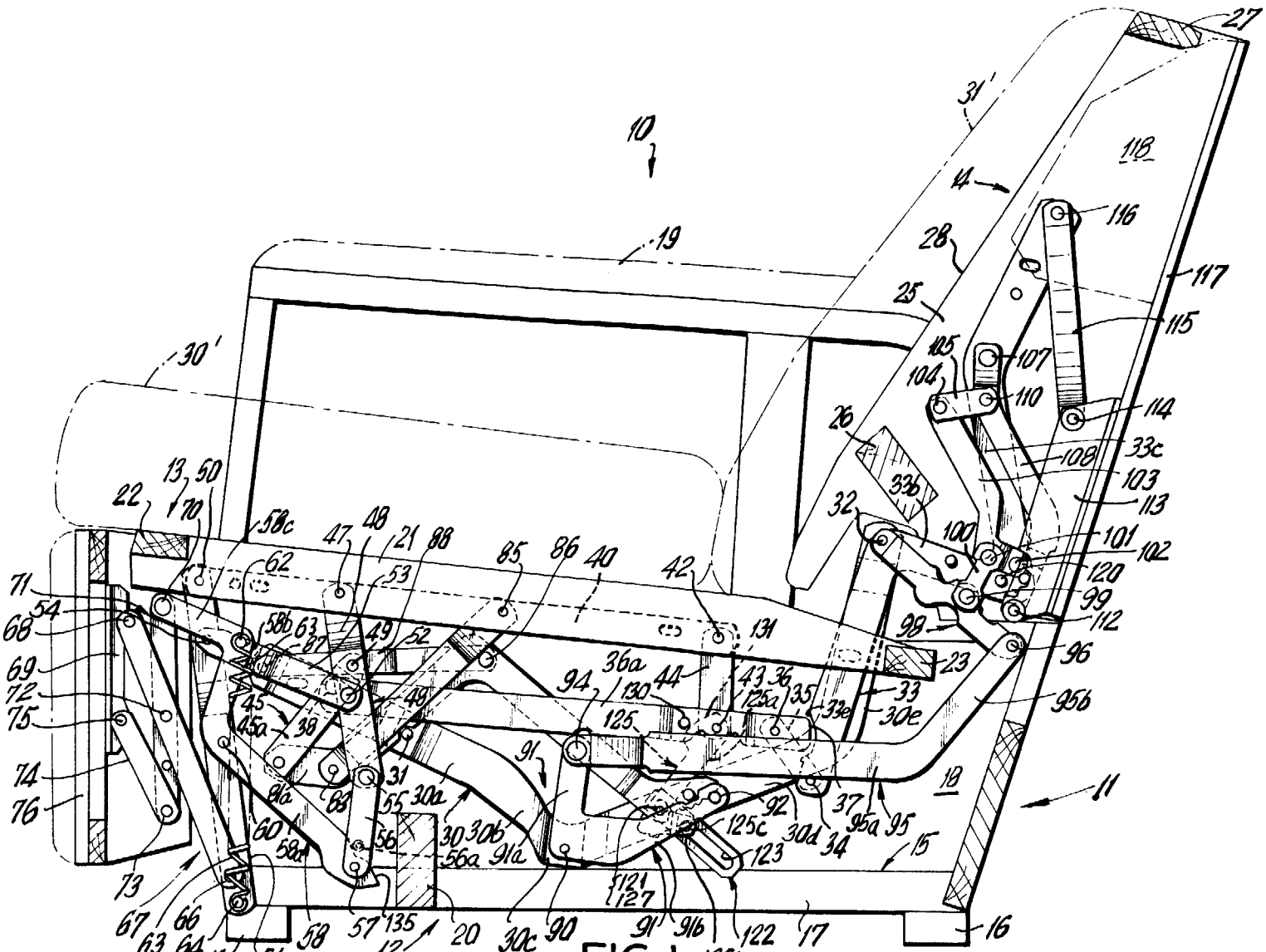

RECLINER LOUNGER T-CUSHION CHAIR WITH PROJECTIBLE HEADREST AND LEGREST, AND HARDWARE THEREFOR

This invention relates to recliner lounger T-cushion chairs with projectible headrest and legrest, and to hardware therefor.

An object of this invention is to provide in a chair of the character described, hardware which will prevent the seat from moving back when going from upright position while allowing the seat to tilt up and down and move forwardly when going between T.V. position and fully reclined position.

Another object of this invention is to provide in a chair of the character described, hardware for projecting a legrest and a headrest when going from upright to T.V. position and allowing the seat to swing up and forward and the backrest to tilt further back, when going from T.V. to fully reclined position.

Another object of this invention is to provide in a chair of the character described, hardware having means to permit the backrest to drive the legrest and the headrest when moving from upright to T.V. to fully reclined positions, and in which the motion of the headrest depends on rotation of the back mounting link about its pivotal connection to the arm mounting link.

Yet another object of this invention is to provide a strong, rugged and durable chair and hardware of the character described, which shall be relatively inexpensive to manufacture and assemble, which shall be comfortable to use, easy to manipulate and yet practical and efficient to a high degree.

Other objects of this invention will in part be obvious and in part hereinafter pointed out.

The invention accordingly consists in the features of construction, combinations of elements, and arrangement of parts which will be exemplified in the construction hereinafter described and of which the scope of invention will be indicated in the following claims.

Figure 2:
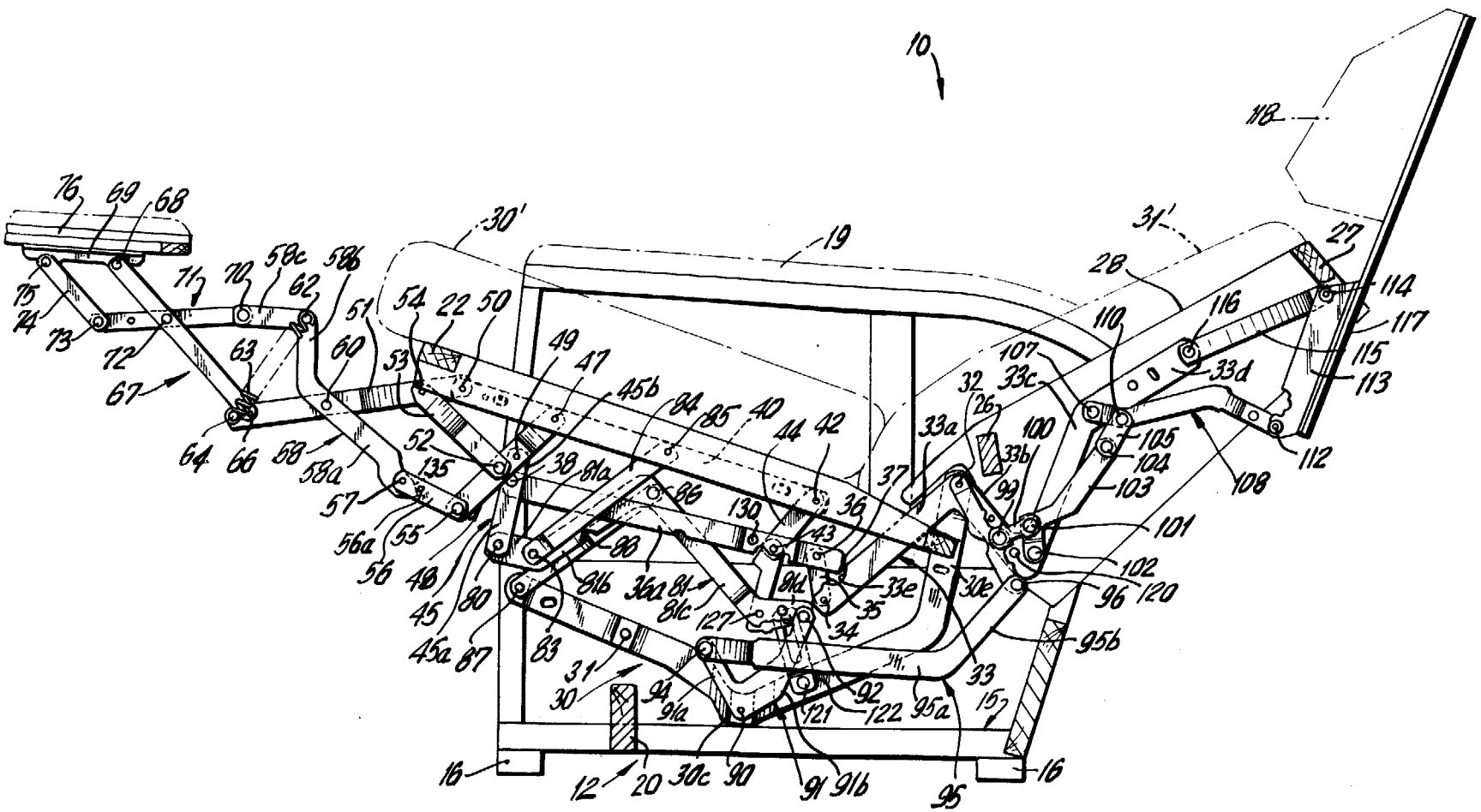

IN THE DRAWINGS:

FIG. 1 is a side elevational view of a chair and hardware therefor, embodying the invention and shown in upright position; and FIG. 2 is a side view of the hardware of FIG. 1, but shown in fully reclined position.

Referring now in detail to the drawing, 10 designates a chair embodying the invention and comprising a chair frame 11 having a base frame 12, a seat frame 13 and a backrest frame 14.

The base frame 12 comprises a bottom frame portion 15 supported on four corner legs 16, and further comprising parallel right and left side bars 17, parallel right and left side arms 18 provided with right and left arm rests 19, and a cross bar 20.

The seat frame 13 has right and left side bars 21, a front cross-bar 22 and a rear cross-bar 23.

The backrest frame 14 comprises side walls 25 connected by a lower cross-bar 26 and a top cross-bar 27. The front edges 28 of the side walls 25 are inclined upwardly and rearwardly, in the upright position of the chair, as shown in FIG. 1.

In the drawing, dot-dash line 30' designates the upholstery of the seat frame 13 and dot-dash line 31' designates the upholstery of the backrest frame 14. The seat frame is made for a T-cushion having front, usual side extentions in front of the arm rests. Thus the seat cannot move rearwardly, but it can and does move forwardly and back to normal position (upright position of the chair), as well as up and then down.

Fixed to each of the inner sides of the side arms 18 of the base frame 11 is an arm mounting link or member 30. When considering the hardware of each side of the chair before attachment to the chair, member 30 is a link. The hardware for the right and left sides of the chair are similar and symmetrically disposed to each other. Therefore the hardware for one side of the chair, only, will be described. The hardware shown is at the right side of the chair (to a person sitting in the chair), and is seen when facing the chair from the left side of the chair.

Said arm mounting link 30 comprises an arm **30*a* which inclines forwardly and upwardly. Extending from the rear of arm 30*a* is a downwardly inclined portion 30*b* dipping to an apex portion 30*c*. Extending from the apex portion 30*c* is a rearwardly and upwardly inclined portion 30*d*, and from which a steeply upwardly inclined portion 30*e* extends rearwardly to a height above the seat frame 13 and to a point somewhat forward of the rear cross-bar 23 of the seat frame. Arm 30*e* is located outside of the seat frame 13. Arm 30*a* carries a stop pin 31 for the purpose hereinafter appearing. At the upper end of arm 30*e* is a pivot pin 32. Pivoted to said pivot pin 32 is a back mounting link 33 fixed to the inside of a side wall 25 of the backrest frame 14. Said back mounting link 33 has an arm 33*a* which is inclined steeply downwardly and forwardly, in the upright position of the chair, as illustrated in FIG. 1, being in such position substantially parallel to and registering with arm 30*e* of the arm mounting link 30 and also located outside of the seat frame 13. In the fully reclined position of FIG. 2, arm 33*a* is inclined at a lesser angle to the horizontal than in FIG. 1. Extending from the upper end of arm 33*a*, said back mounting link is formed with a downwardly and rearwardly inclined portion 33*b*. Extending upwardly and rearwardly from the lower end of portion 33*b* is a portion 33*c*, from the upper end of which there extends an arm 33*d* projecting upwardly and rearwardly, in the fully reclined position of FIG. 2**.

Pivoted to the lower end of arm **33*a* of the back mounting link 33, as on pivot 34, is one end of a toggle connector link 35. The upper end of the toggle connector link 35 is pivoted, as at 36 to a toggle bar 36*a* near the rear end of said bar. Said toggle bar 36*a* extends rearwardly of the pivot 36 and terminates in a rear edge 37 adapted to contact an inner edge 33*e* of a notch in the forward edge of portion 33*a* of the back mounting link 33, when the chair is in the fully reclined position of FIG. 2, to limit rearward movement of the toggle bar. In upright position of the chair, said toggle bar 36*a* is nearly horizontal, and extends forwardly of pivot 36. In such position the forward end of the toggle bar is disposed rearwardly of the front end of the base frame, and said bar is at a level below the seat frame 13. At the front end of the toggle bar 36*a* is a pivot pin 38**.

Attached to the outside of side bar 21 of the seat frame is a seat link 40. The front end of the seat link 40 is located just rearwardly of front seat frame bar 22 and somewhat therebelow. The rear end of the seat link 40 is disposed forwardly of the pivot 36 on toggle bar **36*a*, in the upright position of the chair, as shown in FIG. 1**.

Interconnecting a pivot pin 42 at the rear end of the seat link, with a pivot pin 43 on the toggle bar **36*a*, disposed forwardly of the pivot pin 36, is a rear pivot link 44, disposed in substantially a vertical direction, in the upright position of the chair. A front pivot link 45 is pivoted at an intermediate portion thereof on the pivot pin 38, which is located at the front end of the toggle bar 36***a*. Said front pivot link 45 has a downwardly extending arm 45*a* and an upwardly extending arm 45*b* and tilts upwardly and rearwardly in the fully reclined position of the chair. Arm 45*a* is somewhat longer than arm 35*b*.

Pivoted to the seat link 40, as on pivot 47 located rearwardly of the front end of said seat link, is one end of a legrest or ottoman actuator link 48. The upper end of arm 45*b* of the front pivot link 45, is pivoted, as on pivot 49 to an intermediate portion of the legrest actuator link 48.

Pivoted to the front end of the seat link 40, as on pivot pin 50, is one end of an ottoman or legrest guide link 51. Pivoted to a portion of link 48 just below pivot pin 49, as on pivot pin 52, at one end thereof, is an ottoman or legrest drive link 53. The other end of said legrest drive link 53 is pivoted, as on pivot 54, to the legrest guide link 51, closer to the pivot 50 than to the outer end of said guide link. Pivoted to the lower end of the legrest actuator link 48, as pivot pin 55, is one end of an ottoman or legrest idler link 56. The other end of said legrest idler link 56 is pivoted, as by pivot pin 57, to one end of an ottoman or legrest control lever 58, which, in the fully reclined position of the chair, crosses the ottoman or legrest guide link 51 and is pivoted thereto, as by pivot pin 60. In the fully reclined position of the chair, the ottoman control lever 58 has an arm 58*a* which inclines rearwardly and downwardly. Said control lever 58, in said fully reclined chair position, has an upwardly extending arm 58*b*, from the upper end of which an arm 58*c* extends forwardly. At the junction of arms 58*b*, 58*c* is an anchor pin 62, connected by a coil extension spring 63, to an anchor pin 64 at the lower end of the ottoman guide link 51.

Pivoted to lever 51, near anchor pin 64, as on pivot pin 66, is one end of an ottoman or legrest support lever 67. The outer end of lever 67 is pivoted, as on pivot pin 68, to the upper end of an ottoman or legrest bracket 69.

Pivoted to the outer end of arm 58*c* of the ottoman or legrest control lever 58, as on pivot pin 70, is one end of an ottoman or legrest intermediate lever 71 which crosses the support lever 67 and is interpivoted thereto as by pivot pin 72. Pivoted to the outer end of said intermediate lever 71, as on pivot pin 73, is one end of an ottoman or legrest support link 74, the outer end of which is pivoted, as by pivot pin 75, to the other end of the ottoman or legrest bracket 69. Any suitable ottoman or legrest 76 may be mounted on the brackets 69 at the right and left sides of the chair. In the fully reclined position of the chair, the legrest brackets 69 are substantially horizontal, and the legrest is extended. In the upright position of the chair, the legrest is retracted, and the legrest bracket is in vertical position.

Pivoted to the lower end of arm 45*a* of the front pivot lever 45, as on pivot pin 80, is the forward end of a carrier link 81. In the fully reclined position of FIG. 2, said carrier link 81 has a front arm 81*a* inclined slightly rearwardly and downwardly. Extending from the rear end of arm 81*a*, is an upwardly and rearwardly inclined arm 81*b*, which in the position of FIG. 2, terminates above the toggle bar 36*a*. Extending downwardly and rearwardly from the upper end of arm 81*b* is an arm 81*c*, from the rear end of which there extends rearwardly an arm 81*d*. At the junction of arms 81*a*, 81*b* of carrier link 81 is a pivot pin 83, to which is pivoted the lower end of a seat control link 84, which in the FIG. 2 position of the chair, inclines upwardly and rearwardly and is pivoted at its upper end, as on pivot pin 85, to the seat link between the pivot pins 47 and 42. At the junction of arms 81*b* and 81*c* of carrier link 81, is a pivot pin 86. Pivot pin 86 is connected to a pivot pin 87 on the forward end of arm mounting link, by a main link 88.

Pivoted to a pivot pin 90 at portion 30*c* of the arm mounting link 30, is a bellcrank 91. Said bellcrank 91 has an arm 91*a* extending upwardly from pivot pin 90, in the upright position of the chair, and an arm 91*b* inclined upwardly and rearwardly from said pivot pin, in said position of said chair. The upper end of arm 91*b* of bellcrank 91 is pivoted, as by pin 92, to the rear end of arm 81*d* of the carrier link 81.

At the upper end of arm 91*a* of bellcrank 91 is a pivot pin 94. Pivoted to said pivot pin 94, is the front end of a headrest actuator link 95. Said headrest actuator link 95 has an arm 95*a*, the front end of which is pivoted to said pivot pin 94 and which, in the upright position of the chair is substantially horizontal.

Inclined upwardly from the rear end of arm 95*a*, is an arm 95*b* carrying a pivot pin 96 at its upper end. In the upright position of the chair, pivot pin 96 is located near the rear of the chair back 14, at substantially the height of the seat frame.

Interconnecting the pivot pins 96 and 32 is a headrest control link 98 carrying a pivot pin 99 medially the ends thereof. Pivoted to said pivot pin 99 and inclined upwardly and rearwardly, is a headrest lower connector link 100. At the rear, upper end of connector link 100, is a pivot pin 101.

Pivoted to the back mounting link 33, near the junction of portions 33*b*, 33*c* of said mounting link, as on pivot pin 102, is a headrest crank link 103, which is pivoted, above pivot pin 102, to the pivot pin 101. Pivoted to the upper end (looking at FIG. 2) of link 103, as on pivot pin 104, is the lower end of upper headrest connector link 105.

Pivoted to the back mounting link 33, at the junction of arms or portions 33*c*, 33*d* of said mounting link, as on pivot 107, is one end of a headrest driver link 108. The upper end of the upper connector link 105 is pivoted, as by pivot pin 110, to the headrest driver link 108, close to the pivot pin 107. The outer end of link 108 is pivoted, as on pivot pin 112, to the lower end of headrest bracket 113. The upper end of headrest bracket 113 is pivoted as on pivot pin 114 to the outer end of a headrest idler link 115, the inner end of which is pivoted, as on pivot pin 116, to the upper end of the back mounting link 33.

In the fully reclined position of the chair, links 108 and 115 are inclined rearwardly and upwardly and the headrest is projected. In the upright position of the chair, said links 108 and 115 are inclined downwardly and rearwardly and the headrest is retracted.

Fixed to the headrest brackets 113 at the right and left sides of the chair is a cross backboard 117 extending up above the headrest brackets 113, and fixed to the inside of the upper end of said backboard is a headrest 118.

In the upright position of the chair, the headrest is disposed within the backrest, with the upper end of the headrest at the upper end of the backrest.

In the projected position of the headrest with the chair in T.V. and fully reclined positions, the headrest 118 is disposed up and beyond the upper end of the backrest, as shown in FIG. 2 of the drawing.

Fixed to arm or portion 33*b* of the back mounting link 33 is a stop pin 120 adapted to contact an upper edge of headrest control link 98 to limit movement between said headrest control link and said back mounting link, when moving from upright to T.V. position and from T.V. position to fully inclined position.

Pivoted to arm 30*d* of the arm mounting link 30, as at 121, is a sequence link 122. Said sequence link 122 has a longitudinal slot 123 radial with respect to pivot pin 121.

Pivoted to pivot pin 43 is one end of a sequence throwout lever 125. In the upright position of the chair said sequence throwout lever 125 has an arm 125*a* inclined downwardly and forwardly as illustrated in FIG. 1. Extending rearwardly from the lower end of arm 125*a* is an arm 125*b* projecting rearwardly and inclined downwardly. At the junction of arms 125*a*, 125*b* is a pivot pin 127, pivoting said sequence throwout lever to said carrier link 81 at the junction of arms 81*c* and 81*d* of said carrier link. On arm 125*b* is a pin 125*c* slidably received in slot 123. In the upright position of the chair, pivot pins 127 and 121 are coaxial. This relationship is retained when moving the chair from upright to T.V. positions. When moving from T.V. position to fully inclined position, pivot pin 127 rises to the position shown in FIG. 2.

In the upright position of the chair sequence link 122 projects downwardly and rearwardly from the pivot pin 121. Also in the upright position of the chair pin 125*c* is at the forward or upper end of slot 123.

During movement from upright to T.V. position, the toggle bar 36*a* moves forwardly causing link 44 to rotate in a clockwise direction, moving the seat link forwardly and tilting the front of the seat somewhat upwardly.

On the toggle link 36*a* is a stop pin 130 adapted to contact an edge 131 of sequence throwout lever 125, in the upright position of the chair. The rear edge 37 of the toggle bar 36*a* contacts an edge 33*e* of arm 33*a* of the back mounting link 33 if the occupant attempts to close the legrest in the full reclined position of the chair thus preventing retraction of the legrest.

On the ottoman or legrest link 56 is a stop pin 56*a* adapted to contact an edge 135 on arm 58*a* of ottoman or legrest control lever 58 to stop the legrest linkage in extended position.

When going from upright to T.V. position, the sequence link is rotated about its pin 121 in a counterclockwise direction by pin 125*c* on arm 125*b* of the sequence throwout lever 125. During such movement, both the sequence throwout lever 125 and the sequence link 122 rotate about coaxial pivot pins 127 and 121 respectively.

When the chair reaches the T.V. position, the sequence link is inclined upwardly and rearwardly. When in this position, pin 127 is then free to move by virtue of slot 123 in an upward and forward direction determined by the four bar linkage comprising the carrier link, bellcrank, arm mounting link and main link so that the seat link through its connections to the toggle bar and toggle bar through its connections with the carrier link, may move to the fully reclined position. The fully reclined position can thus be achieved only upon first going to T.V. position.

A T-cushion chair particularly a low back chair with projectible headrest is desireable in living room furniture. In a T-cushion chair, the seat cannot move backward because the seat engages the front ends of the side arms.

Since the seat cannot be permitted to move backward, in operating the chair, the chair hardware or mechanism embodies means to hold the seat link in place against backward movement. The seat herein can move up and down when going between upright T.V. positions. It moves forward and up when going from T.V. to fully reclined position.

From upright position, to go to T.V. position, the occupant pushes back on the backrest. There are double, four bar linkages in the present mechanism.

A third, four bar linkage comprises the main lever 88, the carrier link 81, the bellcrank 91 and the arm mounting link or member 30.

The first two, four bar linkages are:

1. seat link 40, ottoman or legrest actuator link 48, and front pivot lever 45, toggle bar 36a, and rear pivot link 44
2. toggle bar 36a, front pivot lever 45, carrier link 81 and sequence throwout lever 125.

These first two four bar linkages work together to expel or project the ottoman or legrest, and the seat control link 84 acts to prevent rearward motion of the seat link 40 while allowing the seat link to move first up and then down.

During movement of the chair from T.V. to fully reclined positions, the back mounting link 33 swings back. The back mounting link does the driving all the way from upright to T.V. to fully reclined positions.

The motion of the headrest 118 on rotation of backmounting link 33 about its pivotal connection 32 to the arm mounting link 30.

The bellcrank 91 does not rotate when the chair goes from upright to T.V. positions. The headrest actuator link 95 is pivoted at one end on pivot 94 to the bellcrank 91 and at its other end by pivot pin 96 to the headrest control link 98, which in turn, is pivoted to the back mounting link 33 at its pivotal connection 32 to the arm mounting link 30.

During movement from upright to T.V. positions, the upper end of the back mounting link 33 swings backwards to carry the pivot 102 of the headrest crank 103 to the back mounting link 33, down, to swing the headrest crank 103 about its pivot 101 to the lower head rest connector 100 to swing the four bar linkage of the headrest, up, to project the headrest 118.

The pivot point 101 of the lower headrest connector link 100 to the intermediate point on headrest crank 103 is held stationary, vertically, thereby resulting in rotation of the headrest crank 103 about said pivot to raise the headrest through the connection of the upper headrest connector link 105 from the headrest crank 103 to the headrest driver 108 (causing elevation of the four bar headrest linkage to the projected position of the headrest 118).

In the projected or elevated position of the headrest bracket 113, the pivotal centers, 104, 110 of the upper headrest connector link 105 to the headrest driver link 108, and to the headrest crank 103, and the pivotal connection 102 of the headrest crank 103 to the back mounting link 33, are in a vertually straight line, which results in a locked headrest in projected position.

Movement of about one-half inch of the pivot 90 of the lower headrest connector 100 to the headrest control link 98 relative to the backmounting link, results in about 12 inches of movement of the headrest bracket 113 in a generally vertical direction.

The reason that this straight line three pivot point relationship is advantageous is because pressure downwardly on the top of the headrest 118 will be resisted by a strut like construction, to avoid destruction of the linkage below that connection. This is necessitated by the 24 to 1 ratio (approximately) of the driving system to the headrest projection system, which would impose a great pressure on the drive portion of the linkage if there were not the straight line arrangement of these three pivot points.

A safety stop pin 120 on the back mounting link 33, to be engaged with the headrest control link 98, limits movement of the headrest control link relative to the back mounting link 33, to prevent going beyond this straight line three pivot point arrangement. This is desireable because without it (a) the headrest would retract, and (b) the strength gained by the straight line strut arrangement would be destroyed.

After the headrest is up and in T.V. position, it is no longer desirable for the headrest 118 to move relative to the back mounting link 33, when going from T.V. to fully reclined position. In order to do that, the headrest actuator link 95 is connected to the bellcrank 91 and also the headrest control link 98. As the chair goes from T.V. to fully reclined position, the bellcrank 91 rotates to move the pivotal point 94 of bellcrank 91 to the headrest actuator link 95, forwardly, to move the rear end of the headrest actuator link downwardly thereby swinging the headrest control link 98 down, at approximately the same angular velocity as the back mounting link is rotated, so that they both move through about the same angle and stay together to maintain the elevated position of the headrest with respect to the back mounting link 33, and so that the backrest and the headrest move together as a unit during such motion.

Thus, the sequencing which prevents rotation of the bell-crank while going from upright to T.V. positions, and permits rotation of the bellcrank from T.V. to fully reclined position, also prevents rotation of the headrest control link 98, from upright to T.V. thereby causing elevation of the headrest, and permitting rotation of the headrest control link from T.V. to fully reclined, and which, as described above, retains the relativity of the back mounting link and the headrest from T.V. to fully reclined.

The sequence mechanism thus has a dual function.

The toggle bar 36*a* strikes the back mounting link 33 at a notch, when trying to retract the ottoman, with the chair in fully reclined position, to prevent the linkage from operating out of sequence.

It is desired not to collapse the legrest linkage without first going from fully reclined to T.V. position. The reason is that if that is done (collapse of the ottoman in fully reclined position) the linkage will be operated out of sequence and cause damage to the mechanism, or trap the occupant in the chair, because the occupant could then be in an awkward position.

If that could be done, the occupant has to get out of the chair and manually reopen the linkage and then move back to T.V. position first and thereafter to upright position.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be interpreted as illustrative.

I claim:

1. Hardware for a T-cushion chair comprising a seat link, an arm mounting link, a back mounting link pivoted to the arm mounting link and movable from upright position to T.V. and fully reclined positions, a toggle bar, a toggle bar connector link pivotally connected to said back mounting link and also pivoted to said toggle bar near the rear end of said toggle bar, a rear pivot link pivotally connected to said toggle bar, and to said seat link adjacent the rear end of said seat link, a front pivot link pivoted adjacent the front end of the toggle bar, a link pivoted to said front pivot link above the pivotal connection of said front pivot link to said toggle bar, to said seat link closer to the front end of the seat link than to the rear end of said seat link, said back mounting link having an arm projecting downwardly from its pivotal connection to said arm mounting link to its pivotal connection to said toggle bar connector link, said arm of said back mounting link swinging forwardly upon swinging the upper end of said back mounting link forward from upright to T.V. position, to move the toggle bar forwardly.

2. The combination of claim 1, said link which is pivoted to said front pivot link and to said seat link, comprising a legrest actuator link, a legrest bracket, and legrest linkage connecting said legrest bracket with said legrest actuator link and seat link to project said legrest bracket upon swinging the upper end of said back mounting link from upright position to T.V. position.

3. The combination of claim 1, said front pivot link having an arm extending downwardly below its pivotal connection to said toggle bar, a carrier link pivoted at one end to the lower end of said arm of said front pivot link, a seat control link pivotally connected to said carrier link and to said seat link, and a main link pivotally connected to said arm mounting link and to said carrier link.

4. The combination of claim 3, a sequence link pivoted to said arm mounting link, said sequence link being formed with a slot radial relative to the pivotal connection of said sequence link to said arm mounting link, a sequence throwout lever pivoted to said toggle bar, and to said carrier link and carrying a pin slidable in the slot of said sequence link.

5. The combination of claim 4, the pivotal connection of said rear pivot link to said toggle bar, and of said sequence throwout link to said toggle bar, being a common pivotal connection.

6. The combination of claim 5, the pivotal connection of said sequence link to said arm mounting link, and the pivotal connection of said sequence throwout link to said carrier link being coaxial in the upright position of said back mounting link.

7. The combination of claim 6, said sequence link projecting downwardly and rearwardly in the upright position of said back mounting link, and said pin on said sequence throwout lever being disposed at the end of the slot of said sequence link closest to the pivotal connection of said sequence link to said arm mounting link, in the upright position of the back mounting link.

8. The combination of claim 7, and a stop pin on said toggle bar adapted to contact an edge of said sequence throwout lever, in the upright position of said back mounting link.

9. The combination of claim 1, said front pivot link having an arm extending downwardly below its pivotal connection to said toggle bar, a carrier link pivoted at one end to the lower end of said arm of said front pivot link, a seat control link pivotally connected to said carrier link and to said seat link, and a main link pivotally connected to said arm mounting link and to said carrier link, a bellcrank pivoted mediately the ends thereof, to said arm mounting link, said bellcrank having a pair of arms, the rear end of said carrier link being pivoted to one arm of said bellcrank, a headrest actuator link pivoted to another arm of said bellcrank, a headrest control link pivoted, at one end, to said back mounting link and pivoted to the other end of said headrest actuator link, a headrest bracket forming part of a four bar linkage with a portion of said back mounting link, and means controlled by said headrest control link, to project and retract said headrest bracket four bar linkage.

10. The combination of claim 9, said four bar linkage comprising said headrest bracket, an idler link connecting the upper end of said headrest bracket to said back mounting link, a headrest driver link connecting the lower end of said headrest bracket to said back mounting link, said means to project and retract said headrest bracket, comprising a lower headrest connector link pivoted to an intermediate portion of said headrest control link, a headrest crank pivoted at one end to said back mounting link, said lower headrest connector link being pivoted to said headrest crank, and an upper headrest connector link pivoted at one end to said headrest crank and at its other end to said headrest driver link.

11. The combination of claim 10, the pivotal connection of said lower headrest connector link to said headrest crank being closer to the pivotal connection of said headrest crank to said back mounting link than to the pivotal connection of said headrest crank to said upper headrest connector link.

12. The combination of claim 11, and the pivotal connection of said upper headrest connector link to said headrest driver link, being closer to the pivotal connection of said headrest driver link to said back mounting link than the pivotal connection of said headrest driver link to said headrest bracket.

13. The combination of claim 12, the pivotal connections of said upper headrest connector link to said headrest driver link and to said headrest crank, and the pivotal connection of said headrest crank to said back mounting link, being substantially in a straight line, in the T.V. position of said back mounting link.

14. The combination of claim 1, said front pivot link having an arm extending downwardly below its pivotal connection to said toggle bar, a carrier link pivoted at one end to the lower end of said arm of said front pivot link, a seat control link pivotally connected to said carrier link and to said seat link, and a main link pivotally connected to said arm mounting link and to said carrier link, a bellcrank pivoted mediately the ends thereof, to said arm mounting link, said bellcrank having a pair of arms, the rear end of said carrier link being pivoted to one arm of said bellcrank, a headrest actuator link pivoted to another arm of said bellcrank, a headrest control link pivoted, at one end, to said back mounting link and pivoted to the other end of said headrest actuator link, a headrest bracket forming part of a four bar linkage with a portion of said back mounting link, and means controlled by said headrest control link, to project and retract said headrest bracket four bar linkage, said link which is pivoted to said front pivot link and to said seat link, comprising a legrest actuator link, a legrest bracket, and legrest linkage connecting said legrest bracket with said legrest actuator link and seat link to project said legrest bracket upon swinging the upper end of said back mounting link from upright position to T.V. position.

15. The combination of claim 1, a legrest bracket, and legrest linkage connecting the legrest bracket with said seat link and with said means, to project said legrest bracket upon moving said back mounting link from upright position to reclined position, a headrest bracket, and headrest linkage connecting said headrest bracket with said back mounting link and with said means, to project said headrest bracket as said back mounting link swings back from upright position to reclined position, and to retract said headrest bracket as said back mounting link swings back from reclined position to upright position, and to retract said headrest bracket as said back mounting link swings back from reclined position to upright position, said toggle bar and said arm of said back mounting link having means adapted to contact one another in the fully reclined position of said back mounting link to prevent retraction of the legrest linkage when the back mounting link is in fully reclined position.

16. The combination of claim 1, said front pivot link having an arm extending downwardly below its pivotal connection to said toggle bar, a carrier link pivoted at one end to the lower end of said arm of said front pivot link, a seat control link pivotally connected to said carrier link and to said seat link, and a main link pivotally connected to said arm mounting link and to said carrier link, a bellcrank pivoted mediately the ends thereof, to said arm mounting link, said bellcrank having a pair of arms, the rear end of said carrier link being pivoted to one arm of said bellcrank, a headrest actuator link pivoted to another arm of said bellcrank, a headrest control link pivoted, at one end, to said back mounting link and pivoted to the other end of said headrest actuator link, a headrest bracket forming part of a four bar linkage with a portion of said back mounting link, and means controlled by said headrest control link, to project and retract said headrest bracket four bar linkage, the pivotal point of said headrest actuator link to said bellcrank being moved forwardly and downwardly upon going from T.V. position to fully reclined position, and the pivotal connection of said headrest actuator link to said headrest control link, downwardly, as the backmounting link is rotated rearwardly and downwardly, to maintain the elevated position of the headrest bracket with respect to the back mounting link and so that the back mounting link and headrest bracket move together substantially as a unit during the movement of the hardware from T.V. position to fully reclined position.

* * * * *